US010842186B2

(12) United States Patent
Faison

(10) Patent No.: US 10,842,186 B2
(45) Date of Patent: Nov. 24, 2020

(54) ASHTRAY FOR MULTIPLE SMOKING PRODUCTS

(71) Applicant: Todd Faison, West Bloomfield, MI (US)

(72) Inventor: Todd Faison, West Bloomfield, MI (US)

( * ) Notice: Subject to any disclaimer, the term of this patent is extended or adjusted under 35 U.S.C. 154(b) by 371 days.

(21) Appl. No.: 15/871,900

(22) Filed: Jan. 15, 2018

(65) Prior Publication Data

US 2019/0216130 A1 Jul. 18, 2019

(51) Int. Cl.
*A24F 19/06* (2006.01)
*A24F 19/00* (2006.01)

(52) U.S. Cl.
CPC ..... *A24F 19/06* (2013.01); *A24F 19/0035* (2013.01)

(58) Field of Classification Search
CPC ..... A24F 19/06
See application file for complete search history.

(56) References Cited

U.S. PATENT DOCUMENTS

| | | | | |
|---|---|---|---|---|
| 1,143,597 A | | 6/1915 | Clement | |
| 1,364,892 A | | 1/1921 | Weite | |
| 1,527,402 A | | 2/1925 | Fuller | |
| 1,531,248 A | | 3/1925 | Huestis | |
| 1,533,682 A | * | 4/1925 | Woywot | A24F 19/00 220/502 |
| 1,547,337 A | | 7/1925 | Locke | |
| 1,699,278 A | * | 1/1929 | Bruun | A24F 19/0064 206/496 |
| 1,754,766 A | | 4/1930 | Phillips | |
| 1,799,897 A | | 4/1931 | Gronbech | |
| 1,800,665 A | | 4/1931 | Shultz | |
| 1,807,079 A | | 5/1931 | Wilmanns | |
| 1,851,417 A | | 3/1932 | Bradnack | |
| 1,881,540 A | | 10/1932 | Brown | |
| 1,964,388 A | | 6/1934 | Henry | |
| 2,068,513 A | | 1/1937 | Reimer | |
| 2,108,436 A | | 2/1938 | Hardy | |
| 2,203,745 A | | 6/1940 | Walford | |
| 2,248,163 A | | 7/1941 | Talbert | |
| 2,365,946 A | | 12/1944 | Fletcher | |
| 2,531,503 A | | 11/1950 | Dick | |
| 2,539,166 A | | 1/1951 | Savage | |
| 2,567,166 A | | 9/1951 | Dick | |
| 2,576,572 A | | 11/1951 | Clapp | |
| 2,612,896 A | | 10/1952 | Young | |
| 2,703,091 A | | 3/1955 | Kaufman | |

(Continued)

FOREIGN PATENT DOCUMENTS

| | | |
|---|---|---|
| CA | 1070589 A | 1/1980 |
| CH | 206785 A | 8/1939 |

(Continued)

*Primary Examiner* — Eric Yaary
(74) *Attorney, Agent, or Firm* — Wayne State University Patent Clinic

(57) ABSTRACT

Provided herein is an ashtray for multiple smoking products which can be used at impromptu events such as cigar "pop-ups." The ashtray can secure multiple smoking products through the use of flexible fingers. Ash accumulated within the ashtray can be safely deposited into an internal compartment by activating a false bottom, which prevents ash dispersal via wind, thus reducing the probability of potential fire hazards.

12 Claims, 3 Drawing Sheets

(56) References Cited

U.S. PATENT DOCUMENTS

| | | | | | |
|---|---|---|---|---|---|
| 2,716,988 | A | | 9/1955 | Comstock | |
| 2,743,729 | A | * | 5/1956 | Butler | A24F 19/14<br>131/235.1 |
| 2,894,655 | A | | 7/1959 | Miller | |
| 3,994,308 | A | * | 11/1976 | Pancer | A24F 13/18<br>131/256 |

FOREIGN PATENT DOCUMENTS

| | | | |
|---|---|---|---|
| CN | 202375036 | U | 8/2012 |
| ES | 292366 | U | 6/1986 |
| FR | 72767 | E | 7/1960 |
| FR | 72767 | E | 7/1960 |
| FR | 1292481 | A | 5/1962 |
| FR | 2930119 | A | 10/2009 |
| FR | 2930119 | A1 | 10/2009 |
| GB | 189316169 | A | 9/1893 |
| GB | 191318126 | A | 4/1914 |
| GB | 252774 | A | 9/1925 |
| GB | 252774 | A | 6/1926 |
| GB | 265406 | A | 2/1927 |
| GB | 386862 | A | 1/1933 |
| GB | 515901 | A | 12/1939 |
| GB | 584965 | A | 1/1947 |

* cited by examiner

ASHTRAY FOR MULTIPLE SMOKING PRODUCTS

FIELD OF INVENTION

The present invention pertains to ashtrays with tiltable bowl or false bottom; more specifically, the invention pertains to ashtrays that can be portable, used on a variety of surfaces, and accepting of a variety of smoking products.

BACKGROUND OF THE INVENTION

Using ashtrays at "pop-up" events, or at impromptu or any temporary locations, presents challenges regarding safety and comfort. In terms of safety, errant gusts of wind can cause dispersal of unsecured cigars and/or cigarettes, and ash, thus creating a fire and/or pollution hazard. Furthermore, using an ashtray without the aid of a table or platform can be uncomfortable, requiring constant bending over, or awkwardly holding the ashtray.

In locations where ashtrays are more consistently used (e.g., a bar or a cigar lounge), cleaning the ashtray by dumping out the ash presents health concerns, and places a burden on employees in terms of time required to clean the ashtray (i.e., dumping out the ash multiple times) that could be otherwise spent on other tasks.

Ashtrays, generally speaking, are made to accommodate a singular smoking product (e.g., only cigars or cigarettes), affording little overlap between different smoking products. For example, an ashtray designed for cigarettes, may not be able to accommodate a large cigar. Furthermore, even for ashtrays designed for a specific smoking product, variation in said smoking product size (e.g., variations in cigar sizes), may result in the smoking product being held in a less than secure manner.

SUMMARY OF THE INVENTION

The present invention pertains to an ashtray, comprising: a head having a wall portion comprising an open end and a bottom end, and defining a receiving cavity; said bottom end comprising a false bottom pivotably attached to a lever extending outward from said wall portion; a plurality of fingers attached to said wall portion proximal to said open end and extending outward from said wall portion; at least two fingers spaced to support a smoking product. The ashtray of the present invention, wherein a shelf is attached to the outside of said wall portion; wherein an elevating member is attached to said head proximal to said bottom end. The ashtray of the present invention, wherein the elevating member is stabilized by a base, and wherein the smoking product is a cigar, cigarette, pipe, or vaporizer.

The present invention pertains to an easily deployable, ergonomic, and safe ashtray that affords the opportunity to secure a number of smoking devices. Ash can be disposed through the use of a valve, which deposits ash into the internal compartment of the ashtray. The present invention has a base unit that provides stability for both elevated, free-standing use, and/or table top usage.

The ergonomic benefits of the present invention include minimal medial and lateral rotation of arm during smoking process while sitting. When used on a table-top, the ashtray allows for minimal medial and lateral rotation of arm while sitting or standing. The lightweight design allows the invention to be deployed to temporary locations, and the adjustable height provides a range of potential surfaces in which the device can be used.

The invention has a plurality of flexible fingers that allow a variety of smoking implements to be used. A user-actuated rotating valve allows at-will ash removal into the enclosed space within the cylinder: this prevents ash dispersal via wind, thus reducing the probability of potential fire hazards; furthermore, the valve provides a barrier for still smoking ash, thus reducing user exposure to combustion products, and allowing for a more enjoyable smoking experience. Accordingly, the reduced exposure to, and storage of, ash reduces the need for frequent cleaning, thus providing in increased sanitation, and relieves the burden on employees.

DETAILED DESCRIPTION

Throughout this specification, unless specifically stated otherwise or the context requires otherwise, reference to a single step, composition of matter, group of steps or group of compositions of matter shall be taken to encompass one and a plurality (i.e. one or more) of those steps, compositions of matter, groups of steps or group of compositions of matter.

Those skilled in the art will appreciate that the present disclosure is susceptible to variations and modifications other than those specifically described. It is to be understood that the disclosure includes all such variations and modifications. The disclosure also includes all of the steps, features, compositions and compounds referred to or indicated in this specification, individually or collectively, and any and all combinations or any two or more of said steps or features. The present disclosure is not to be limited in scope by the specific examples described herein, which are intended for the purpose of exemplification only. Functionally-equivalent compositions and methods are clearly within the scope of the disclosure.

Figure 1:
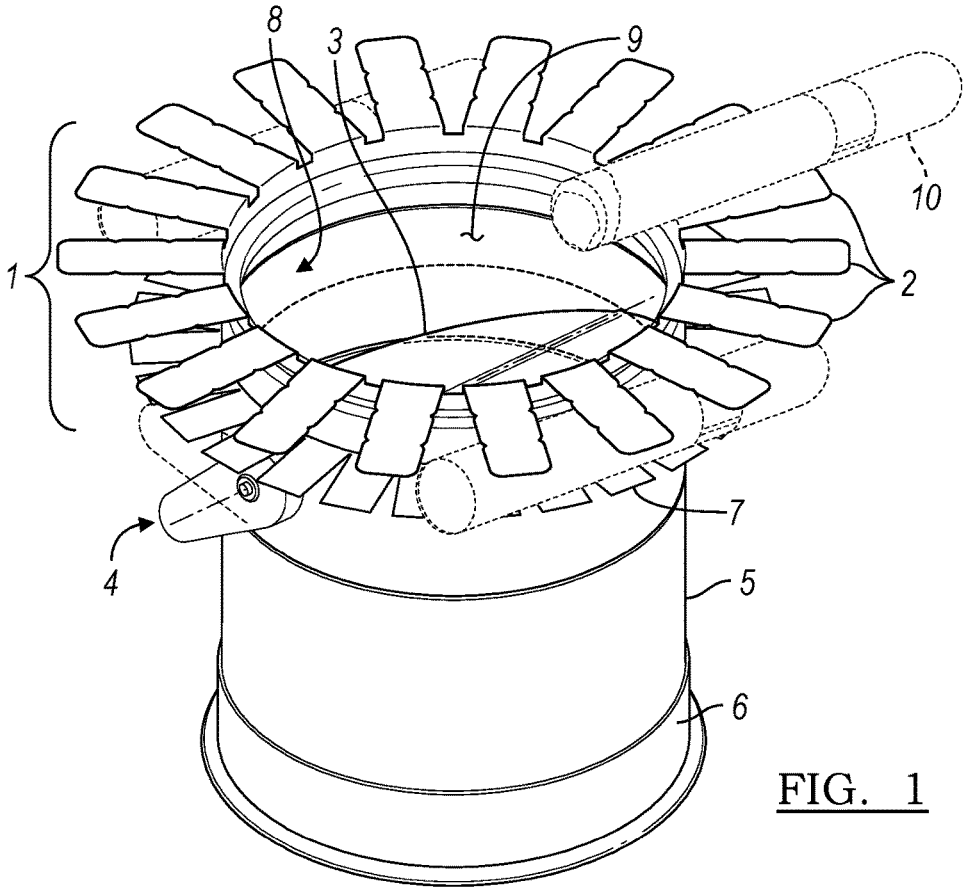
FIG. 1 a perspective providing a general overview of the present invention.

Referring to FIG. 1, the ashtray may have a head 1 having a wall portion 8 with an open end 9, and a bottom end which is a false bottom 3, which defines a receiving cavity. The false bottom 3 is activated by a lever 4, which is pivotably attached, extending outward from the wall portion 8. The external part of the wall portion 8 has an outer shelf 7. The open end 9 of the head has a plurality of fingers 2 that radiate outwards away from the open end 9 of the wall portion 8. An elevating member 5 raises the head 1 and provides a connection point that joins the head 1 and base 6. Smoking products, such as a cigar 10, can rest upon the fingers 2, or be grasped by the fingers 2; alternatively, a smoking product such as cigar 10 can be sandwiched between fingers 2 and outer shelf 7.

The fingers 2 may be a flexible protrusion and/or flange and/or plurality of the same, that can be bent and/or adjusted to receive and/or secure and/or store a variety of items. The fingers can be bent in any direction to either accommodate variously sized items, and/or to pin, secure, and/or hold items to the astray and/or between the fingers and the outer shelf. The fingers can be fashioned to possess a gap and/or distance of varying widths between adjacent fingers. For example, in some embodiments, the gap between adjacent fingers can be less than the full width of the smoking product but greater than the gap present when adjacent fingers are flush, thus allowing a smoking product to rest with aid of gravity.

In some embodiments, the elevating member 5 elevates the head above the platform and/or location where the invention is to be used. The elevating member can be any shape, and can be hollow, or solid albeit for a space that allows ash, debris, waste, trash, and/or disposed smoking products to accumulate without interfering with the action of the false bottom 3.

Smoking products may include cigars; cigarettes; cheroots; stogies or stogys; cigarillos; cigarette pipes; vaporizers; vape; vape-pen; carburetor smoking device; straight-tube smoking device; beaker-shaped smoking devices; round-base smoking devices; multi-chamber smoking devices; G-pens; tobacco blunts; tobacco one-hitters; bidis and/or any other smoking product, device, or apparatus, used singly, doubly, and/or in any other number the ashtray is capable of supporting. Some embodiments may accommodate multiple cigars styles and shapes, including, but not limited to parejos such as coronas; petite coronas; churchills; robustos; corona gordas; double coronas; panetelas; lonsdales; figurados such as pyramids; belicosos; torpedos; perfectos; culebras; diademas; cigars comprising colors such as double claros or candelas; claros; Colorado claros; Colorados; Colorado maduros; maduros; oscuros; and/or any combination thereof.

In some embodiments, the head 1 receiving container, i.e., the open end 9, the wall portion 8, the outer shelf 7, and plurality of fingers 2 can be fashioned from a single piece of metal, plastic, and/or other suitable material. FIG. 1 shows such an embodiment where the head is made of single piece of material. In other embodiments, the head can be fashioned using separate components and/or materials. For example, in some embodiments, the receiving container can be made using a suitable heat resistant metal, and the plurality of fingers can be fashioned using a separate piece and/or pieces of suitable heat resistant materials, known to those having ordinary skill in the art.

Figure 2:
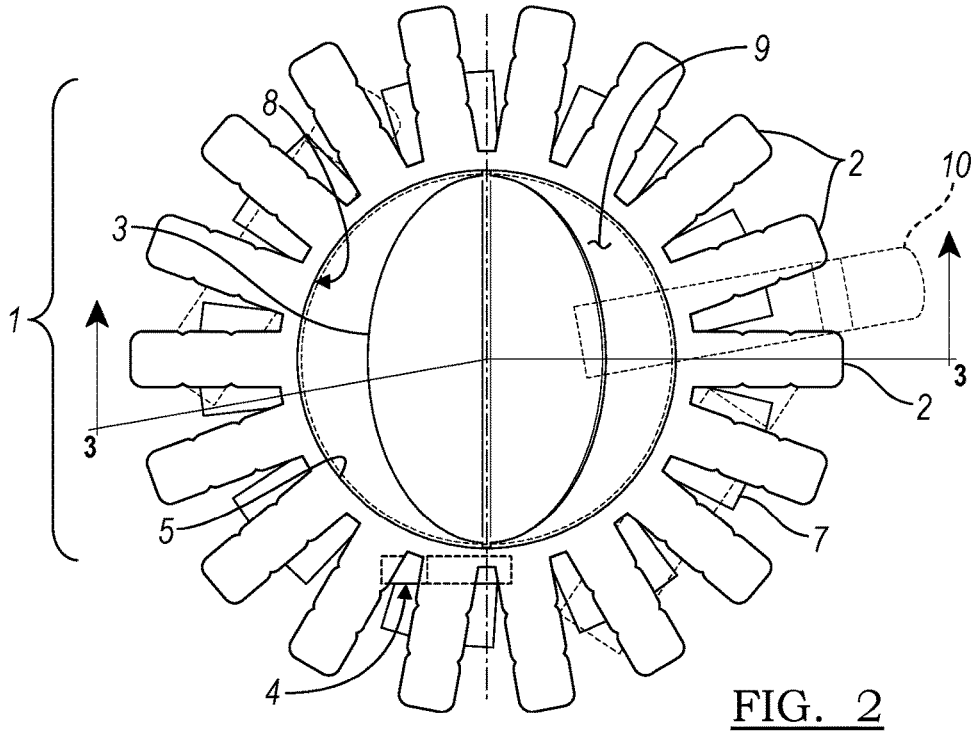
FIG. 2 an overhead view of the invention showing an embodiment with a butterfly valve.

Referring now to FIG. 2, an overhead view of the embodiment in FIG. 1 is shown. In some, the false bottom 3 is a butterfly valve that can be actuated by turning a handle 4.

Figure 3:
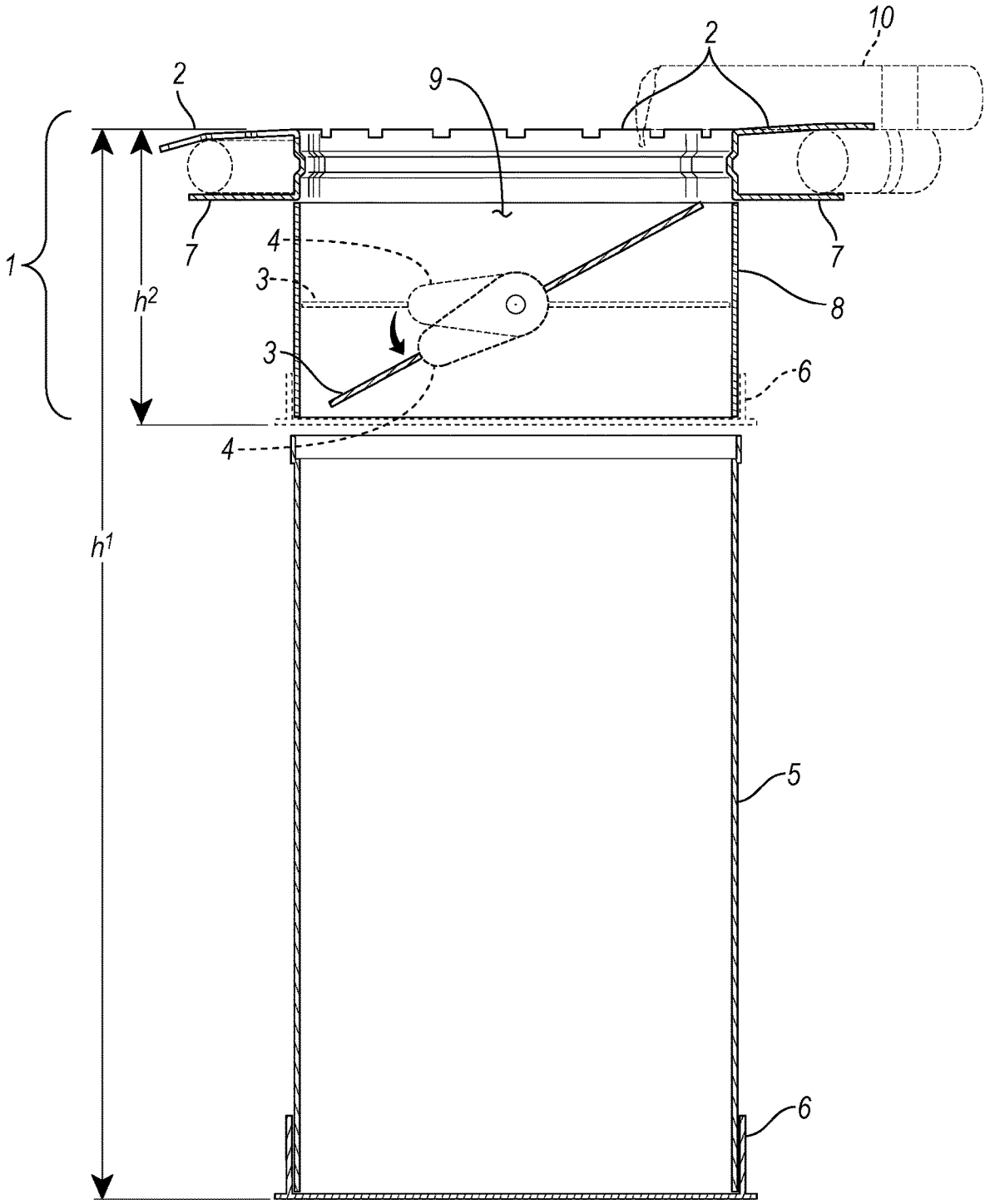
FIG. 3 a vertical cross section showing an example of two possible embodiments.

In FIG. 3, depicts a vertical cross section of the ashtray. The astray may have the head 1 joined to the base 6 (as shown with the dashed line) creating a short height $h^2$. Alternatively, in some embodiments, the ashtray may have the head 1 joined to the elevating member 5, which can then be joined to the base 6 creating a long height $h^1$.

Figure 4:
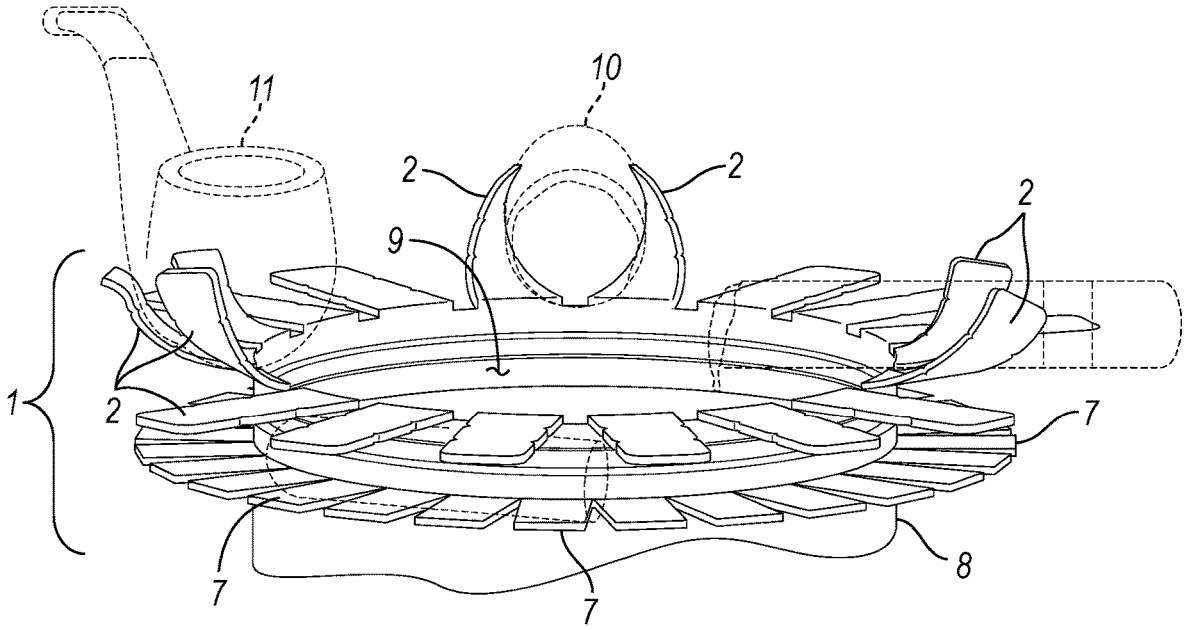
FIG. 4 a close-up view of the plurality of fingers showing the accommodation of multiple smoking products.

Referring to FIG. 4, the plurality of fingers 2 are flexible, and can be bent and/or molded to accommodate a variety of smoking products. In some embodiments, a pipe 11 and/or cigar 10 can be held or secured by the fingers 2. In some embodiments, a smoking product, such as a pipe 11; can be secured by creating a cradle with the fingers 2, or by forming a grip or pincers (as shown with the cigar 10); or can be pinned, held, and/or sandwiched between the outer shelf 7, the wall portion 8, other fingers 2, or any combination thereof.

In some embodiments, the adjacent fingers may be flush, effectively possessing no gap and/or an imperceptible gap, and the smoking product can be secured by bending the fingers to either create a gap capable of providing support with the aid of gravity, and/or by bending the fingers to mechanically stabilize the smoking product.

The ashtray described herein can be fashioned into a variety of shapes including, but not limited to, circular, oval, triangular, rectangular, trapezoidal, square, pentagonal, hexagonal, heptagonal, octagonal, nonagonal, decagonal, dodecagonal, polygonal, or any other shape. In some embodiments, the head 1, elevating member 5, and base 6, or the head 1, and base 6 (in the height $h^2$ configuration) can possess different shapes as long as the subsequent members can be joined in a suitable fashion.

The head 1, elevating member 5, and base 6 comprising height $h^1$, or the head 1, and base 6 comprising height $h^2$, can be joined by methods known to those having ordinary skill in the art. For example, in some embodiments possessing a circular shape (such as the embodiments shown in FIG. 1) the head 1, elevating member 5, and base 6 comprising height $h^1$, or the head 1, and base 6 comprising height $h^2$, can be joined using a taper, e.g., a Morse taper; conical taper, and/or locking-taper between all or some of the foregoing components.

In some embodiments, the receiving container defined by a head 1 having a wall portion 8, with an open end 9, and a bottom end which is a false bottom 3, can be about 2 to 8 inches deep. The open end 9 of the head 1 can be about 3 to 12 inches in width or diameter. In some embodiments, there can be about 10 to 42 fingers 2, each individual finger 2 spaced to allow adequate manipulation, each finger 2 being about 1 to 4 inches long, and having a diameter or width of about 5 to 18 inches. In some embodiments, the shelf 7 can be about 1 inch to 4 inches long. In some embodiments, the false bottom 3 can be about 3 to 12 inches in width or diameter. In some embodiments, the elevating member 5 can be about 1 foot to 4 feet long. In some embodiments, the handle 4 can be about 2 to 5 inches long. In some embodiments, the base 6 can be about 3 to 12 inches in width or diameter.

In some embodiments, the receiving container can be about 4 inches deep, and the open end 9 of the head 1 can be about 6 inches in diameter; with about 21 fingers 2, each spaced at about ¾ of an inches apart, and about 2 inches long, with a diameter of about 9 and ½ inches; the shelf 7 can be about 2 inches long from the wall portion 8, with about an 8 to 9 inch diameter; the false bottom 3 can be about 5 and ¾ inches in diameter to about 6 inches in diameter; the handle 4 can be about 3 and ¼ inches long; the elevating member 5 can be about 42 inches long, and 6 inches in diameter; and the base 6 can be about 2 inches deep, and 6 inches in diameter.

In some embodiments, a cone-shaped male end or shank of a given taper angle, at the bottom end of the head 1, the elevating member 5 and/or the base 6, can be inserted into a corresponding component (e.g., the bottom end of the head 1 into the base 6) which possesses a female receiver with an equal taper angle. In such an example, the degree or size of the angle for both the male and female parts will influence the ease in which the component parts can be removed. For example, if the total taper angle is greater than about 14 degrees (or semicone angles greater than about 7 degrees), the taper will be self-releasing, steep, or fast. In some embodiments possessing a self-releasing taper, other means known to those having ordinary skill in the art will be required to secure the component parts (e.g., a drawbar and screws).

In yet other embodiments, the taper angle between the component parts can be less than 14 degrees (or semicone angles less than 7 degrees), having a self-holding, self-locking, and/or locking taper. In embodiments possessing a self-holding taper, the component pieces can be secured without additional means, i.e., the component parts are secured when axial force is applied. In such an embodiment, the tapered cylinder of either the bottom end of head 1, elevating member 5, or base 6, is inserted into a matching tapered hole (i.e., its corresponding female part, e.g., the bottom end of head 1 into base 6) and external force acting in the axial direction causes the components to be securely joined.

In some embodiments, the head 1 can possess a male threaded bottom end which can be screwed into the elevating member 5 or the base 6, which have a female threaded end that corresponds to the male thread of the head 1. Alternatively, the head 1 can possess a female threaded bottom end which can be screwed into the elevating member 5 or the base 6, which have a male threaded end that corresponds to the female thread of the head 1.

In some embodiments, the ashtray and/or its components can possess a circular, oval, triangular, rectangular, trapezoidal, square, pentagonal, hexagonal, heptagonal, octagonal, nonagonal, decagonal, dodecagonal, polygonal, and/or other shape. These embodiments can be joined using a taper, or by other means known to those having ordinary skill in the art. In embodiments where a taper is not used to fit the components via friction, the components can be joined my methods including, but without limitation, adhesives; brazing; cementing; crimping; magnetism; soldering; taping; welding; gluing; screwing; and/or nailing components together. Items and/or methods that may be used to join the components of the present invention include glue; nails; bolts; rivets; cam connectors; brads; concave bolt connectors; fasteners; insertion nuts; Keku fasteners; mechanical fasteners; push-on fasteners; screws; staples; wire nails; snap clip connectors; tacks; hammer drive anchors; lag screw shields; toggle wings; hex nut sleeve anchors; drop-in anchors; toggle wing bolts; hammer drive mushroom head anchors; plastic anchors; wedge anchors; flat head sleeve anchors; acorn nut sleeve anchors; hammer drive flat head anchors; and/or any other connecting means or combination thereof.

The present invention can be composed of any material capable of receiving ash, debris, trash, refuse, and/or any other item deposited into the ashtray. Furthermore, the material selected may also be capable of receiving graphics, logos, print, and/or any other design applied thereon. In some embodiments, the present invention can be composed of steel, including but not limited to galvanized steel, stainless steel, alloy steel, carbon steel, and/or any alloy of iron and carbon with or without other elements; aluminum, including but not limited to aluminum alloy with elements such as copper, magnesium, manganese, silicon, tin, zinc, and/or any other suitable element; non-metal material including but not limited to ceramics, clay, pottery, glass and/or crystalline ceramics, and/or any other ceramic material with or without other materials (e.g., fiber-reinforced materials embedded) therein; fire-resistant, fire-retardant, fire-safe, and/or heat-resistant wood; fire-resistant, fire-retardant, and/or heat-resistant plastic, polymers and/or plastic compounds; stone; bone; and/or any other suitable material capable of serving as an ashtray, and/or any of its component parts.

In some embodiments, the present invention can be composed of lightweight, commercially available aluminum that is both known and readily available to those having ordinary skill in the art. The aluminum head 1 can be attached to an aluminum elevating member 5, which can subsequently be attached to an aluminum base 6, via friction between the components, or crimped edges where the components join. Furthermore, the head 1, elevating member 5, and base 6, or head 1 and base 6 need not be of the same materials (i.e., different materials may be used in combination, e.g., aluminum head 1 with galvanized steel base 6).

The false bottom 3 which makes up the bottom end of the head 1 can be any type of trap door or false bottom that allows the dumping of ash, debris, waste, trash, and/or any other item into the elevating member 5 and/or base 6.

The ashtray can have a false bottom 3 which can be a valve, including but not limited to a butterfly valve; duplex valve; concentric butterfly valve; doubly-eccentric butterfly valve; high-performance butterfly valve; double-offset butterfly valve; wafer-style butterfly valve; normal wafer valve; lug valve; or rotary valve.

Alternatively, the ashtray can have a false bottom 3 which is comprised to two segments of equal size that join in the middle, such as a dual-flap trapdoor, and when the lever is activated, the segments or flaps move away from each other by pivoting downwards, thus creating a gap, and allowing the ash and/or other debris to fall into the elevating member or base.

In some embodiments, the elevating member 5 is hollow, which allows ash, debris, waste, trash, and discarded smoking products to pass freely through the elevating member 5 and accumulate in the base 6.

In some embodiments, the elevating member 5 is solid, with the exception of a hollow space that allows ash to accumulate in said hollow space.

In some embodiments, the elevating member 5 is hollow, and contains a collection bin or bag or bin. The collection bag or bin can be composed of steel, including but not limited to galvanized steel, stainless steel, alloy steel, carbon steel, and/or any alloy of iron and carbon with or without other elements; aluminum, including but not limited to aluminum alloy with elements such as copper, magnesium, manganese, silicon, tin, zinc, and/or any other suitable element; non-metal material including but not limited to ceramics, clay, pottery, glass and/or crystalline ceramics, and/or any other ceramic material with or without other materials (e.g., fiber-reinforced materials embedded) therein; fire-resistant, fire-retardant, fire-safe, and/or heat-resistant wood; fire-resistant, fire-retardant, and/or heat-resistant plastic, polymers and/or plastic compounds; stone; bone; and/or any other suitable material capable of serving as an ashtray, and/or any of its component parts, in the form of a mesh, chain link, or solid container, depending on the material used.

The plurality of fingers 2 can be fabricated out of a flexible material and/or a non-flexible material with joints or knuckles that allow the smoking product to be secured. For example, in some embodiments the fingers 2 can be fabricated from aluminum, which can be bent by the user to allow the smoking product to be secured, and/or two or more fingers 2 can be bent to allow the cigar to rest with the aid of gravity. Referring to FIG. 4, the fingers 2 can be bent and/or molded to secure the smoking product, and/or bent to widen the gap between adjacent fingers in order to allow the smoking product to rest between said fingers.

In some embodiments, a finger 2 can be a series of adjacent ball and socket joint connectors that, when connected, create a flexible finger 2 unit that can be bent and/or molded to grip and/or accommodate the smoking product.

Alternatively, in some embodiments, the fingers 2 can possess knuckles between finger segments. As used here, the term "knuckles" can refer to a circular plate having a central aperture and a shank extending radially to connect to the wall portion 8. The circular plate can be adapted to be snugly nested between two outer circular plates, and secured via a pin that extends across the plates and through aperture, thereby pivotally connecting two finger segments. The term "finger segments" means any length of material separating the knuckles of a finger.

The ashtray described herein can be used in the following way: the fingers may be used to hold cigars by pinning the cigar between two fingers. Alternatively, the ashtray may be used by letting the cigar rest in the gap between two fingers; here, the gap can be increased or shortened to accommodate cigars of differing diameters. Because the gap can be adjusted, cigarettes, and/or any other smoking device can be used. The fingers can be used to pinch, grasp, or pin smoking materials between other fingers, the wall portion of the ashtray, and/or the shelf.

The ashtray may be used by depositing cigar ash into the open end of the head, and allowing it to accumulate on the false bottom. When the ash is ready to be disposed of, the operator can activate the lever and dump the ash into the elevating member or the base of the ashtray. The lever can then be reset, allowing the false bottom to return, sealing off access to the elevating member and/or the base.

Although illustrative embodiments of the present invention have been described herein with reference to the accompanying drawings, it is to be understood that the invention is not limited to those precise embodiments, and that various other changes and modifications may be effected by one skilled in the art without departing from the scope or spirit of the invention.

The invention claimed is:

1. An ashtray, comprising:

A head having a wall portion comprising an open end and a bottom end, and defining a receiving cavity;

said bottom end comprising a false bottom pivotably attached to a lever extending outward from said wall portion;

a plurality of fingers attached to said wall portion proximal to said open end and extending outward from said wall portion;

the said fingers arranged and spaced to encircle the perimeter of said wall portion; and at least two of said fingers spaced to support a smoking product.

2. The ashtray of claim 1, wherein a shelf is attached to the outside of said wall portion.

3. The ashtray of claim 1, wherein an elevating member is attached to said head proximal to said bottom end.

4. The ashtray of claim 3, wherein the elevating member is stabilized by a base.

5. The ashtray of claim 1, wherein the smoking product is a cigar, cigarette, pipe, or vaporizer.

6. The ashtray of claim 5, wherein the smoking product is a cigar.

7. An ashtray, comprising:

A head comprising a wall portion having an open end and a bottom end, and defining a receiving cavity;

said bottom end comprising a valve pivotably attached to a straight handle extending outward from said wall portion;

a plurality of fingers attached to said wall portion proximate to said open end and extending outward from said wall portion;

the said plurality of fingers arranged and spaced to encircle the perimeter of said wall portion, at least two of said fingers spaced to support a smoking product; and said at least two of said fingers comprising a malleable material adapted to selectively bend said fingers to support said smoking product.

8. The ashtray of claim 7, wherein a quadrate shelf is attached to the outside of said wall portion.

9. The ashtray of claim 7, wherein the head is attached to a rectangular elevating member is proximate to said bottom end.

10. The ashtray of claim 9, wherein the rectangular elevating member is stabilized by a quadrate base.

11. The ashtray of claim 1, wherein said head is of a cylindrical, rectangular, or hexagonal shape.

12. The ashtray of claim 7, wherein said head is of a cylindrical, rectangular, or hexagonal shape.

* * * * *